United States Patent [19]

Bock et al.

[11] Patent Number: 4,712,482

[45] Date of Patent: Dec. 15, 1987

[54] PROJECTILE WITH ACTIVE COMPONENTS

[75] Inventors: Erich Bock; Gerald Rieger, both of Nuremberg, Fed. Rep. of Germany

[73] Assignee: Diehl GmbH & Co., Nuremberg, Fed. Rep. of Germany

[21] Appl. No.: 927,247

[22] Filed: Nov. 4, 1986

[30] Foreign Application Priority Data

Nov. 28, 1985 [DE] Fed. Rep. of Germany ..... 3542051

[51] Int. Cl.[4] ..... F42B 11/00

[52] U.S. Cl. ..... 102/501; 102/357; 102/476; 102/517

[58] Field of Search ..... 102/491–497, 102/501, 517–519, 340, 342, 351, 357, 476, 489, 473

[56] References Cited

U.S. PATENT DOCUMENTS 1,325,706 12/1919 Tadisco ..... 102/495
2,798,431 7/1957 Semon et al. ..... 102/495
3,732,818 5/1973 Thomanek .
4,499,830 2/1985 Majerus .
4,553,482 11/1985 Weber et al. ..... 102/529

*Primary Examiner*—Harold J. Tudor
*Attorney, Agent, or Firm*—Scully, Scott, Murphy & Presser

[57] ABSTRACT

A projectile with active components or energy-producing bodies which possesses a cylindrical sheathing wall, and which are maintained axially stacked between a projectile base and a projectile head or tip, and wherein there is provided an ejecting arrangement on the projectile for the ejection of the active components. The sheathing or wall structure of each active component is provided with at least two axially-parallel, through-extending bores, in which tie bolts are extended through the aligned bores of the sheathing wall structures of the active components, which tie bolts are fastened at one end thereof to the projectile base and at the other end thereof to the projectile head, wherein each tie bolt possess rupturing or breaking points in the region of the projectile base, in the region of the abutting location between two active components, and in the region of the projectile head.

6 Claims, 3 Drawing Figures

PROJECTILE WITH ACTIVE COMPONENTS

BACKGROUND OF THE INVENTION

1. Field of the Invention

The present invention relates to a projectile with active components or energy-producing bodies which projectile possesses a cylindrical sheathing wall, and which in which the components are maintained axially stacked between a projectile base and a projectile head or tip, and wherein an ejecting arrangement is provided on the projectile for the ejection of the active components.

2. Discussion of the Prior Art

It is known to arrange active components or energy-producing members which possess thick sheathing or casing walls, such as, for example, active components constituted of P-charges, in essence, shaped charges or hollow projectile-forming charges, within projectiles with a thin-walled projectile casing. Problems are encountered with such projectiles concerning their strengths or stability from the standpoint of the firing stability of the projectile and of the active components, the transmission of the spin from the weapon barrel or launch tube to the projectile or the active components, and the ejecting sequence for the active components.

In the disclosure of German Petty Pat. No. 82 18 780 there is disclosed a projectile, in which a multiplicity of active components, which are stacked up between a projectile base and a projectile head, are held together through the utilization of a tie rod or anchoring bolt, which fractures during the ejection sequence. The tie rod extends centrally through the active components. However, for active components including P-charges, in essence, shaped projectile-forming charges, this type of arrangement cannot be employed.

In the disclosure of European Pat. No. A2 0 114 602 there is set forth a description of a projectile for the transport of a plurality of active components or bodies. The thin projectile casing is relieved of any stresses which are generated during the firing and during flight. The inherent stability or mechanical rigidity of the active components is not employed for the relieving of the stresses in the projectile.

SUMMARY OF THE INVENTION

Accordingly, it is an object of the present invention to provide a projectile of the above-mentioned type in which there is eliminated a separate or actual projectile casing, and in which the active components themselves impart the necessary stability or physical rigidity or strength to the projectile.

Inventively, the above-mentioned object is attained in a projectile of the above-mentioned type, in that the sheathing or wall structure of each active component is provided with at least two axially-parallel, through-extending bores, tie bolts being arranged to extend through the aligned bores of the sheathing wall structures of the active components, which tie bolts are each fastened at, respectively, one end thereof to the projectile base and at the other end thereof to the projectile head, wherein each tie bolt possess rupturing or breaking points in the region of the projectile base, in the region of the abutting location between two active components, and in the region of the projectile head.

The sheathing wall structures of the stacked active components hereby, in themselves, form the projectile casing . Due to the presenced of the tie bolts, the projectile head and the projectile base are tensioned with respect to each other through the sheathing walls. The projectile possesses the necessary stability or strength during firing. The transmission of the spin takes place from the projectile base through the active components to the projectile head. At the initiation of the ejecting sequence, the tie bolts break at the rupturing or breaking points. As a result thereof, the active components are released from each other and from the projectile base and the projectile head.

In a preferred embodiment of the invention, a clamping arrangement is formed on each tie bolt within the confines of each sheathing wall structure. As a consequence thereof, subsequent to the breaking of the rupturing points, the tie bolt parts will remain within the bores. Moreover, with the sheathing wall structures, there will not be encountered any substantial differences in the masses of material, which would be inexpedient for shaped projectile-forming or so-called P-charges.

BRIEF DESCRIPTION OF THE DRAWINGS

Further advantageous embodiments and features of the invention can now be ascertained from the following detailed description of an exemplary embodiment thereof, taken in conjunction with the accompanying drawings; in which.

DETAILED DESCRIPTION

Figure 1:
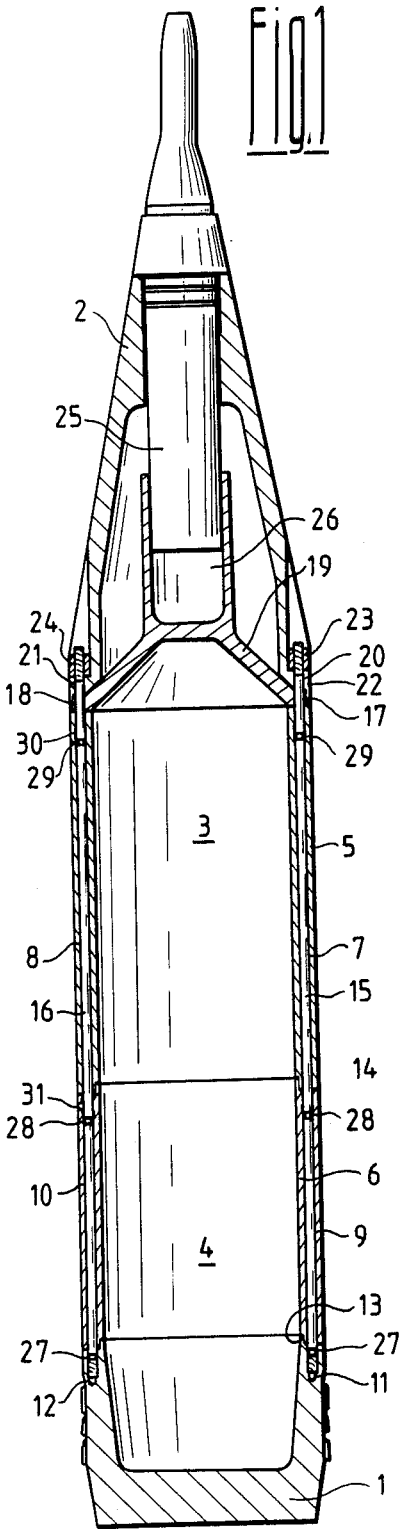
FIG. 1 illustrates a longitudinal sectional view through a projectile.

Stacked upon each other between a projectile base 1 and a projectile head or cone 2 are two active components or energy-producing bodies 3 and 4 which are constituted of P-charges. The sheathing wall structures of the active components are identified by reference numerals 5 and 6. The external diameter of the projectile base 1, that of the projectile head 2, and that of the active components 3, 4 are in alignment with each other.

Provided in each sheathing wall 5, 6 are axially-parallel, through-extending bores 7 and 8 and, respectively, 9 and 10. The projectile base 1 possesses threaded bores 11 and 12. For the centering of the projectile base 1 and the active components 3 and 4, gradations or steps 13, 14 are formed on the base 1 and, respectively, the sheathing wall structures 5 and 6. In order to facilitate the aligned orientation of the bores 7, 9, 11, and respectively 8, 10 and 12, the steps 13, 14 can also be constituted of serrations or toothings extending over a portion of the circumference.

Tie bolts 15, 16 are screwed into the threaded bores 11 and 12, which tie bolts extend through the bores 7, 9 and, respectively, 8, 10. The tie bolts 15, 16 extend through guide bores 17, 18 in an ejection cylinder 19 which is supported within the projectile head 2, and through the bores 20, 21 in as flange or shoulder 22 on the projectile head 2. The tie rods are clamped on the flange 22 by means of clamping nuts 23, 24.

The ejection cylinder 19 is displacably supported on a detonator 25 located in the projectile head 2. A gas chamber 26 is present between the detonator 25 and the ejection cylinder 19. The ejection cylinder 19 contacts against the sheathing wall 5.

Formed on, respectively, the tie rod 15 and 16, is a first rupturing or breaking location 27 in the region of the projectile base 1. In the region of the abutting location between the active components 3 and 4, there is provided a second rupturing or breaking location 28 on the tie bolts 15, 16. A third rupturing or breaking location 29 is located near the projectile head 2.

The diameter of each of the tie bolts 15, 16 is slightly larger between the breaking locations 27, 28 than the diameter between the breaking locations 28 and 29. The diameter of each of the tie bolts 15, 16 is slightly larger between the breaking locations 28 and 29 than between the breaking location 29 and the clamping nut 23 and 24. Formed in the bores 7 through 10 are suitable contact stops 30, 31 for the tie bolt section possessing the larger diameter. The distance between the contact stop 30 and the breaking location 29 is greater than the distance between the stop 31 and the breaking location 28 (referring to FIG. 1).

At the firing of the projectile, the sheathing wall structures 5 and 6 absorb the firing acceleration. The tie bolts 15, 16 transmit the spin acceleration. When the detonator 25 is triggered, the ejection cylinder 19 then presses against the casing wall structure 5, and through the sheating wall structure 6 against the projectile base 1. Consequently, the tie bolts 15 and 16 initially rupture at the breaking locations 27. As a result, this causes the release of the projectile base 1. Thereafter, the sheathing wall structures 5, 6 displace themselves towards the tie bolts 15, 16 so that the contact stop 31 will strike against the greater diameter of the tie bolts 15, 16 at the breaking locations 28. As a result, there will also rupture the breaking locations 28. At this time, the active component 4 is released. Finally, the contact stop 30 of the active component 3 strikes against the section having the greater diameter at the breaking location 29. Consequently, there are ruptured the breaking location 29, so that the active component 3 is now also released from the projectile head 2.

Figure 2:
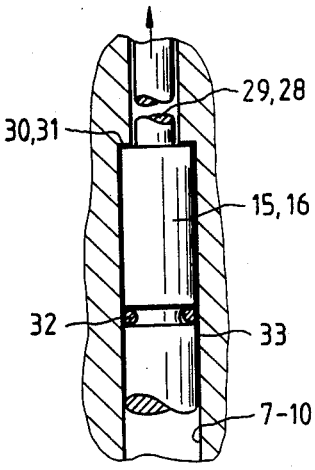
FIG. 2 illustrates, on an enlarged scale, a fragmentary sectional view of a clamping arrangement on a tie bolt.

In order to avoid the parts of the ruptured apart tie bolts 15, 16 from exiting from the bores 7, 8 and 9 and 10, in accordance with the embodiment of FIG. 2, supported on each of the tie bolt 15, 16 within the bores 7, 9 and 8 and 10, is an O-ring 32 which presently clamps fast the applicable tie bolt part contained within the bore along a ring-shaped surface 33, when this is moved up to the contact stop 30 or 31.

Figure 3:
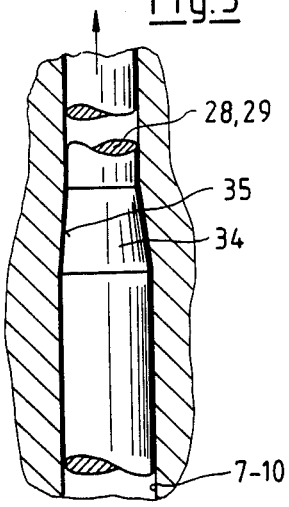
FIG. 3 illustrates an alternative embodiment in comparison with that of FIG. 2.

Instead of the O-ring 32 and the ring-shaped surface 33, in the embodiment pursuant to FIG. 3, each of the tie bolts 15, 16 within the bores 7 to 10' has a self-locking conus 34 provided thereon, which has a complementary conical surface 35 of the bores 7 to 10 associated therewith. The conus 34 and the conical surface 35 replace the contact stops 30 and 31 of the embodiment of FIG. 2. When the conus 34 is pulled into the conical surface 35, this will cause the applicable breaking location 28, 29 to rupture. Due to the self-locking action of the conus 34, the tie bolt part will remain retained within the sheathing wall structure 5 and 6.

What is claimed is:

1. A projectile with active components which possess a cylindrical sheathing wall structure and are retained axially stacked in abutting contact between a projectile base and a projectile head; an ejecting arrangement for the ejection of the active components in said projectile, the sheathing wall structure of each said active component including at least two aligned axially-parallel through-extending bores; tie bolts extending through the aligned bores of the sheathing wall structures of said active components, each of said tie bolts having one end fastened to the projectile base and an opposite end fastened to the projectile head; breaking locations being provided on said tie bolts proximate the projectile base, proximate the abutting contact locations between said active components and proximate the projectile head; and means for clampingly engaging said tie bolts in said bores of the sheathing wall structure whereby, upon rupturing of the tie bolts at the breaking locations responsive to ejection of the active components, the separated parts of the tie bolts remain within the respective bores.

2. A projectile as claimed in claim 1, wherein the sheathing wall structure possesses a stepped configuration at the abutting contact locations between said active components.

3. A projectile as claimed in claim 1, wherein a contact stop for each said tie bolt is arranged in each said sheathing wall structure, such that during ejection, the tie bolt initially pushes against the contact stop of the active component which is more distant from the ejecting arrangement and thereafter against the contact stop of the active component which is more proximate to said ejecting arrangement.

4. A projectile as claimed in claim 1, wherein the clamping means comprises an O-ring clamping within said bores against a ring-shaped surface.

5. A projectile as claimed in claim 1, wherein said clamping means comprises a conus on each of said tie bolts, and a complementary conical surface cooperating with said conus formed in one of the bores.

6. A projectile as claimed in claim 5, wherein the conical surface in said bore forms a contact surface in cooperation with said conus for retaining the tie bolt parts in said bores.

* * * * *